US007794126B2

(12) United States Patent
Ishida et al.

(10) Patent No.: US 7,794,126 B2
(45) Date of Patent: Sep. 14, 2010

(54) VEHICLE LAMP

(75) Inventors: Hiroyuki Ishida, Shizuoka (JP); Shohei Fujiwara, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 53 days.

(21) Appl. No.: 12/042,203

(22) Filed: Mar. 4, 2008

(65) Prior Publication Data

US 2008/0225541 A1 Sep. 18, 2008

(30) Foreign Application Priority Data

Mar. 14, 2007 (JP) ..... 2007-065060

(51) Int. Cl.
*F21V 7/00* (2006.01)

(52) U.S. Cl. ..... 362/516; 362/235; 362/249.02; 362/297; 362/341; 362/545

(58) Field of Classification Search ..... 362/235–236, 362/249.01–249.02, 296.01, 297, 341, 346–348, 362/516–518, 543–545
See application file for complete search history.

(56) References Cited

U.S. PATENT DOCUMENTS

| | | | | |
|---|---|---|---|---|
| 6,332,701 | B1 | 12/2001 | Yamada et al. | |
| 2004/0085779 | A1* | 5/2004 | Pond et al. | 362/516 |
| 2005/0281048 | A1 | 12/2005 | Coushaine et al. | |
| 2006/0133104 | A1* | 6/2006 | Okubo et al. | 362/545 |
| 2007/0019432 | A1 | 1/2007 | Shimada | |
| 2007/0115656 | A1 | 5/2007 | Chou et al. | |

FOREIGN PATENT DOCUMENTS

| | | | |
|---|---|---|---|
| DE | 39 29 955 | A1 | 3/1991 |
| DE | 10 2004 017 454 | A1 | 1/2005 |
| JP | 2004-111355 | A | 4/2004 |
| JP | 2004-241388 | A | 8/2004 |
| JP | 2004-342574 | A | 12/2004 |
| JP | 2005-078938 | A | 3/2005 |
| JP | 2006-276325 | A | 10/2006 |
| TW | I262276 | B | 9/2006 |

OTHER PUBLICATIONS

German Official Communication issued in German Application No. 10 2008 011 647.5 issued on Aug. 7, 2008 and English translation thereof, 7 pages.
Patent Abstracts of Japan, Publication No. 2004-342574, Publication Date: Dec. 2, 2004, 2 pages.
Patent Abstracts of Japan, Publication No. 2004-241388, Publication Date: Aug. 26, 2004, 2 pages.
Patent Abstracts of Japan, Publication No. 2004-111355, Publication Date: Apr. 8, 2004, 2 pages.

* cited by examiner

*Primary Examiner*—Sandra L O'Shea
*Assistant Examiner*—Meghan K Dunwiddie
(74) *Attorney, Agent, or Firm*—Osha Liang LLP

(57) ABSTRACT

A vehicle lamp includes a plurality of semiconductor light emitting devices, and a reflector for reflecting light emitted from the semiconductor light emitting devices toward a front side of the vehicle lamp. The reflector is partitioned into a plurality of light emitting areas that are radially formed around an optical axis extending in a front-rear direction of a vehicle. Each of the semiconductor light emitting devices is disposed on an outer peripheral portion of one of the light emitting areas respectively. Each of the reflecting surfaces of the reflector is provided in one of the light emitting areas respectively.

8 Claims, 5 Drawing Sheets

VEHICLE LAMP

This application is based on and claims priority from Japanese Patent Application No. 2007-065060, filed on Mar. 14, 2007, the entire contents of which are hereby incorporated by reference.

BACKGROUND

1. Technical Field

The present disclosure relates to a vehicle lamp including a plurality of semiconductor light emitting devices, and a reflector for reflecting light from these semiconductor light emitting devices to a forward area of the lamp.

2. Background Art

In recent years, various vehicle lamps that are effective for a reduction of power consumption, and a reduction of heat generation, have been proposed variously (see e.g., Japanese Unexamined Patent Documents: JP-A-2004-342574; JP-A-2004-241388; and JP-A-2004-111355). According to such configurations, light source supporting column shaped into a circular or square column is provided on a center axis (optical axis) of a reflector whose reflecting surface is formed like an almost hemisphere and then a plurality of LEDs (semiconductor light emitting devices) as a light source are arranged on an outer peripheral surface of the light source supporting column.

However, in configurations such as the above in which a plurality of LEDs are arranged around the light source supporting column positioned on a center axis of the reflector, the LEDs, which also serve as the heating member, are arranged densely on the light source supporting column at a high density Therefore, a sufficient heat radiation area cannot be secured around the LEDs, and there is a risk that a luminous efficiency of the LEDs is decreased or a life of the LEDs is shortened due to the excessive temperature rise.

Also, in the above Patent Documents, a reflector is disclosed that includes plural reflecting surfaces, each having different reflecting characteristics are formed around the light source supporting column on which the LEDs are arranged. The plural reflecting surfaces shift positions in the circumferential direction, so that a plurality of light distribution patterns can be given by one lamp. However, a light emitted from one LED is incident on plural reflecting surfaces having different light distribution patterns respectively, or a part of the light reflected by one reflecting surface is reflected again by other reflecting surfaces. As a result, interference occurs between plural light distribution patterns. Thus, it is difficult to control respective light distribution patterns with high precision.

SUMMARY

One or more embodiments of the present invention provide a vehicle lamp that can improve heat radiation characteristics of semiconductor light emitting devices used as a light source, and also can prevent mutual interference between plural light distribution patterns provided to the reflector so as to control respective light distribution patterns with high precision.

According to one or more embodiments of the present invention, a vehicle lamp includes: a plurality of semiconductor light emitting devices; and a reflector for reflecting light emitted from the semiconductor light emitting devices toward a front side of the vehicle lamp, wherein the reflector is partitioned into a plurality of light emitting areas that are radially formed around an optical axis extending in a front-rear direction of a vehicle, and each of the semiconductor light emitting devices is disposed on corresponding one of outer peripheral portions of the light emitting areas and each of reflecting surfaces of the reflector is provided in corresponding one of the light emitting areas.

According to the vehicle lamp having the above configuration, mounting positions of the semiconductor light emitting devices are set to the outer peripheral portion of the reflector that provides the reflecting surfaces in respective light emitting areas and the semiconductor light emitting devices in the adjacent light emitting areas are largely separated mutually in the configuration. Therefore, a sufficient heat radiation area can be ensured around the semiconductor light emitting devices and thus the heat generated from the semiconductor light emitting devices can be radiated or such heat can be transferred effectively to the reflector, so that the heat can be radiated from the large rear surface area of the reflector to the outside. Accordingly, a temperature rise due to heat generation of the semiconductor light emitting devices themselves can be prevented.

Also, because the mounting positions of the semiconductor light emitting devices are set to the outer peripheral portion of the reflector, in a plurality of light emitting areas radially formed around the optical axis, the boundary portions between the adjacent light emitting areas constitute the ridge line portions being higher than the surrounding area and the mounting positions of the semiconductor light emitting devices. The ridge line portions project toward the front side of the vehicle lamp gradually as they come close to the center point through which the optical axis passes.

Also, with such configuration, each of the ridge line portions, which are provided in a boundary between the adjacent light emitting areas, functions as a light shielding wall for preventing a situation in which the light emitted from the semiconductor light emitting devices being assigned to the light emitting areas enters into another unassigned light emitting area, and also functions as another light shielding wall for preventing a situation in which a part of the light reflected by one reflecting surface in one light emitting area is reflected again by other reflecting surfaces in other light emitting area. Therefore, mutual interference between the light distribution patterns in the light emitting areas can be prevented, and thus the light distribution patterns in the respective reflecting surfaces can be shaped with high precision.

According to one or more embodiments of the present invention, the vehicle lamp further may include: a lighting circuit for lighting individually the semiconductor light emitting devices provided in the light emitting areas, wherein the reflecting surfaces in the light emitting areas have a different light distribution pattern respectively.

According to the above configuration, when a plurality of light distribution patterns are synthesized as a whole, formation of the light distribution patterns in a more complicated illuminance distribution can be facilitated without providing a complicated light distribution adjusting mechanism such as the movable shade, or the like. Therefore, formation of the light distribution patterns that conforms to the legal regulations for the illuminance distribution can be facilitated Also, a plurality of light distribution patterns can be switched simply by switching the light emitting areas in which the semiconductor light emitting devices are turned on respectively.

According to one or more embodiments of the present invention, each of the semiconductor light emitting devices may have a light emitting portion shaped into almost a rectangle, and the semiconductor light emitting device in the light emitting area located under the optical axis may be disposed such that a major axis of the light emitting portion intersects orthogonally with the optical axis.

According to the above configuration, the reflecting surface in the light emitting area positioned under the optical axis is shaped into the diffusing reflecting surface that diffuses and reflects the light emitted from the semiconductor light emitting device. Therefore, the diffusion light that diffuses in width direction of vehicle and acts as a base of various light distributions can be obtained easily, and the light distribution pattern having a broad irradiation width can be easily obtained by the diffusion light.

According to one or more embodiments of the present invention, the vehicle lamp further includes: optical components being provided to a forward area of the semiconductor light emitting devices and adjusting an emission direction of lights emitted from the reflecting surfaces and the semiconductor light emitting devices.

According to the above configuration, not only the light distribution adjustment performed by the reflecting surfaces of the reflector, but also, the light distribution adjustment performed by the optical components provided on the forward area of the semiconductor light emitting devices can be applied. As a result, the light distribution patterns can be adjusted with high precision.

According to one or more embodiments of the present invention, the reflector may be partitioned into the plurality of light emitting areas by ridge line portions protruding toward the front side of the vehicle lamp, the ridge line portions may be provided in a boundary between the respective reflecting surfaces, and each of the ridge line portions may come together at a center point of the reflector through which the optical axis passes, and the center point may protrude most toward the front side of the vehicle lamp from the reflecting surfaces.

According to one or more embodiments of the present invention, each of optical components may have at least one of a lens function and shading function, the lens function may adjust the emission direction of the lights and the shading function may block a part of the lights.

According to one or more embodiments of the present invention, the optical components may include a lens member having a ¼ spherical shape.

According to one or more embodiments of the present invention, the vehicle lamp may further include a plurality of radiation fins formed on a rear surface of the reflector.

According to one or more embodiments of the present invention, the vehicle lamp may further include: dimming means for adjusting a luminous intensity of the semiconductor light emitting devices; and leveling means for adjusting the optical axis, wherein the light distribution pattern can be switched to various light distribution patterns by the dimming means or the leveling means.

Therefore, a temperature rise due to heat generation of the semiconductor light emitting devices themselves can be prevented, and a reduction of the light emitting performance or the life of the semiconductor light emitting devices caused due to an excessive temperature rise can be prevented.

Other aspects and advantages of the present invention will be apparent from the following description, the drawings, and the claims.

DETAILED DESCRIPTION

A vehicle lamp according to one or more embodiments of the present invention will be described in detail with reference to the accompanying drawings hereinafter.

Figure 1:
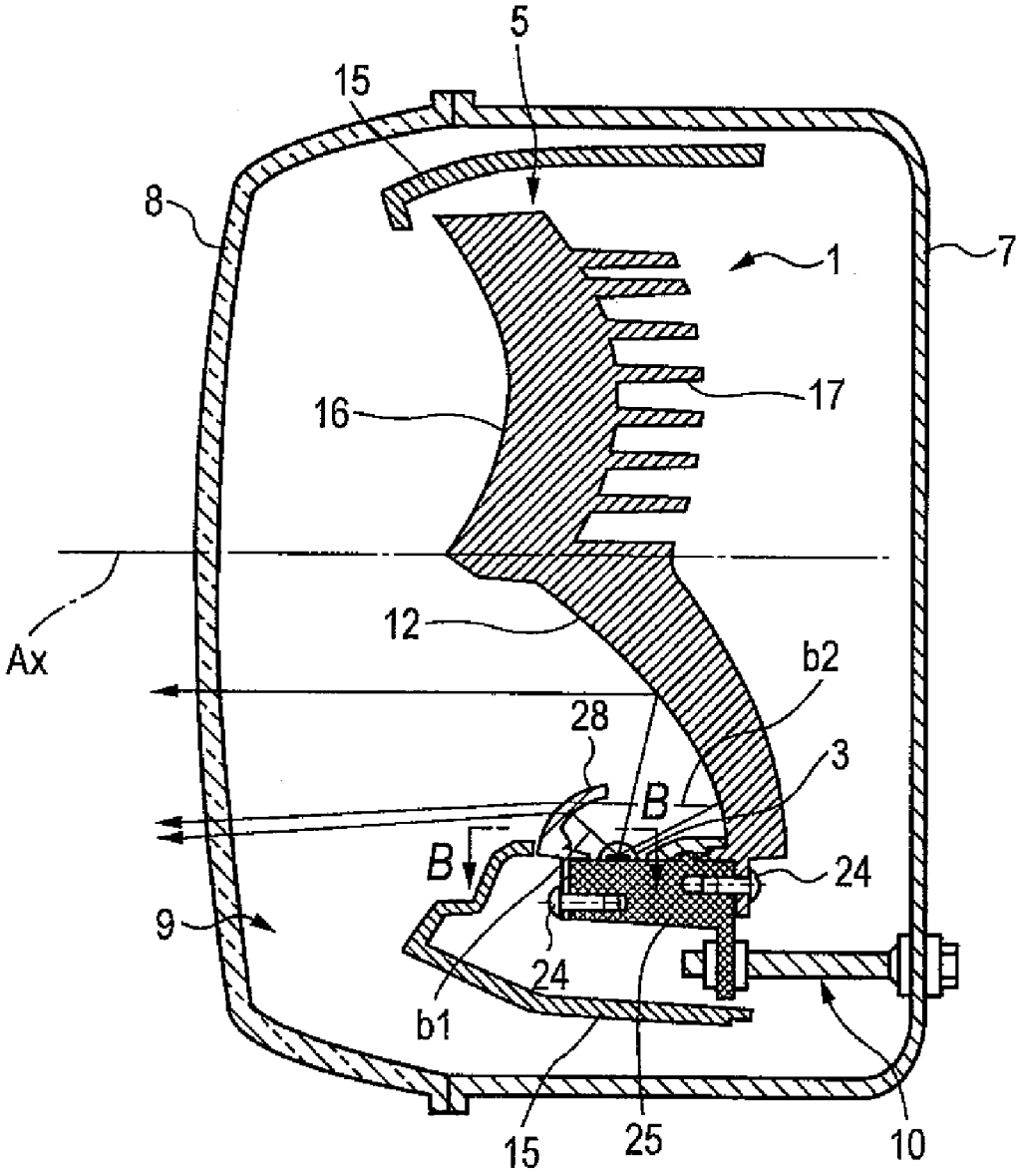
FIG. 1 is a longitudinal sectional view showing a vehicle lamp according to an embodiment of the present invention.
Figure 2:
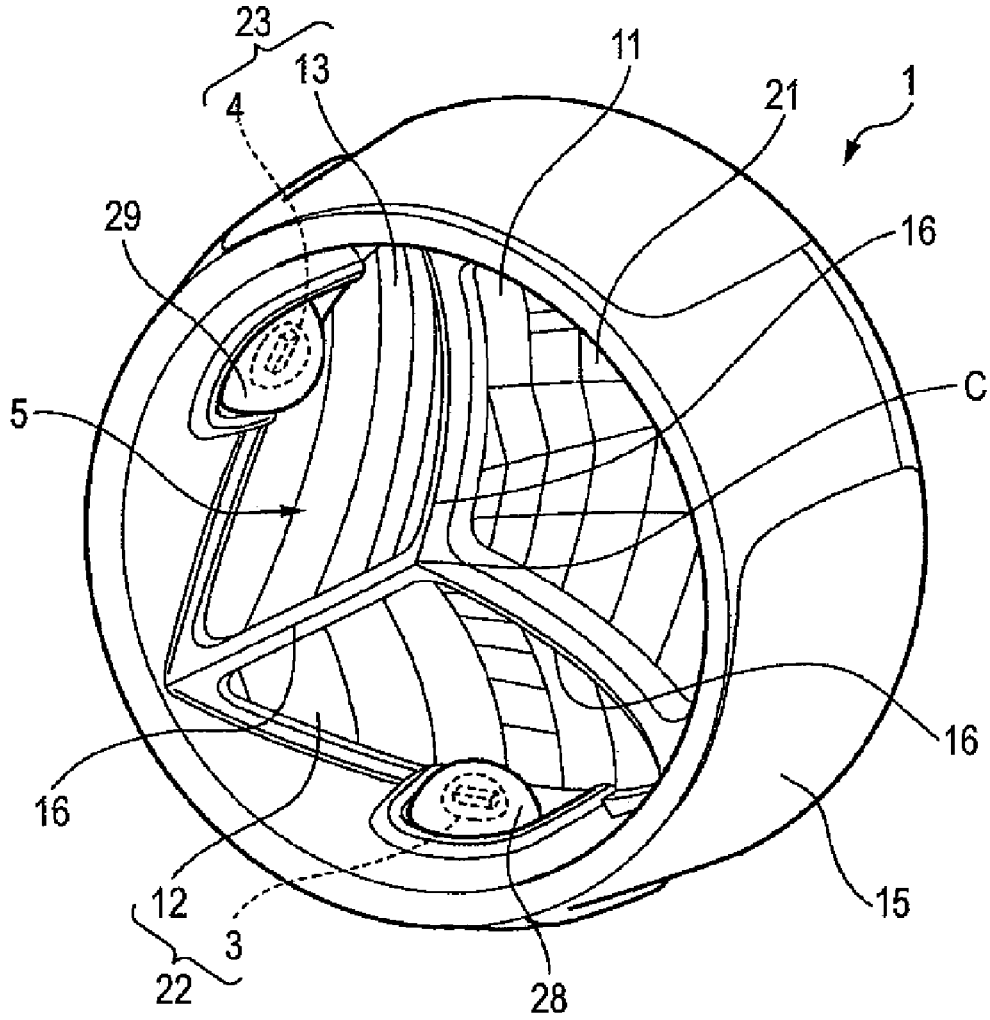
FIG. 2 is a perspective view of the vehicle lamp shown in FIG. 1.
Figure 3:
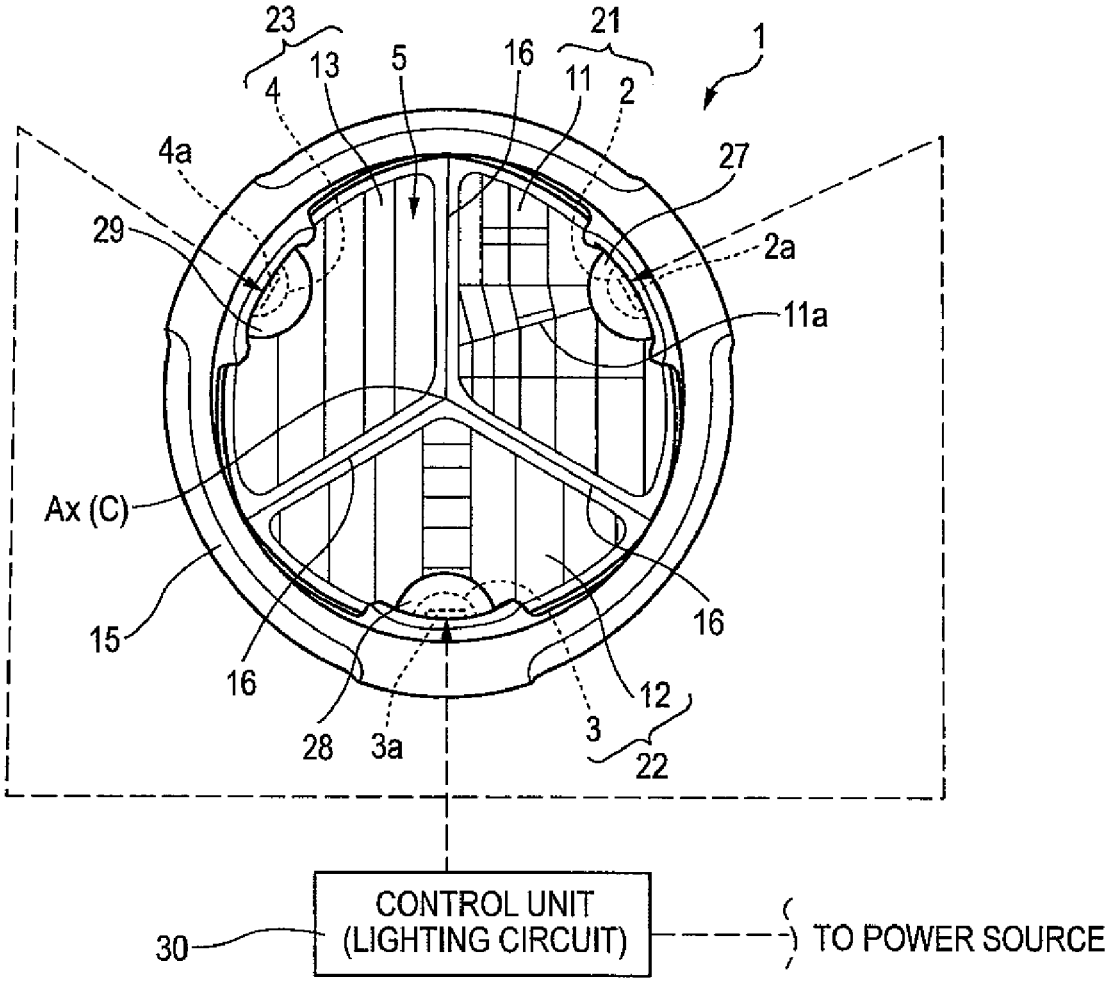
FIG. 3 is a front view of the vehicle lamp shown in FIG. 2.
Figure 4:
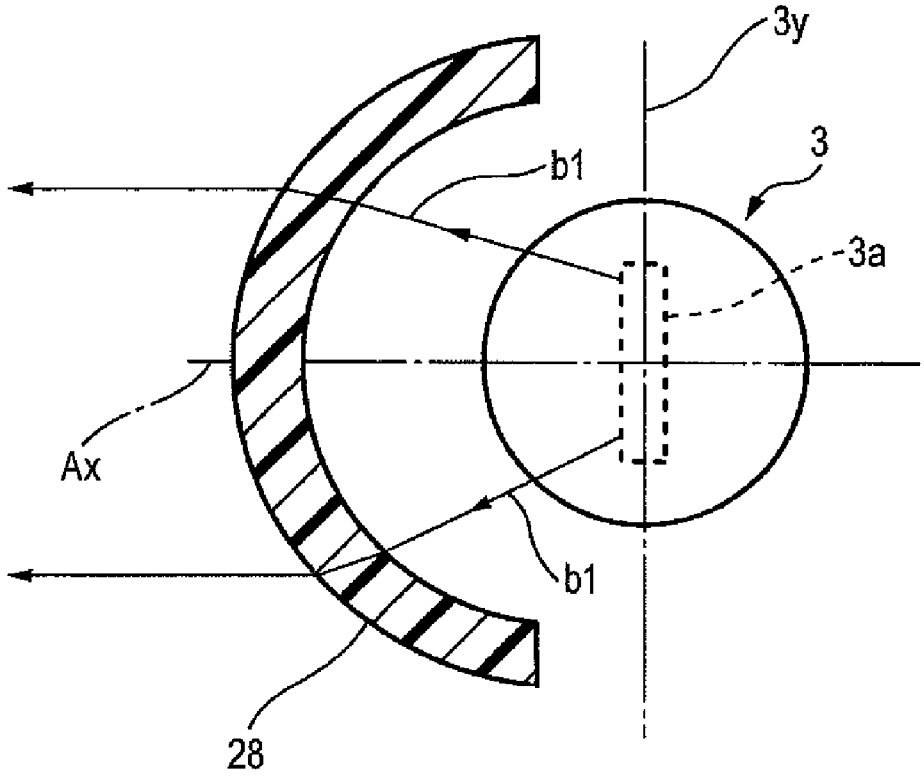
FIG. 4 is a sectional view of the vehicle lamp shown in FIG. 1 taken along a B-B line.

FIG. 1 is a longitudinal sectional view showing a vehicle lamp according to an embodiment of the present invention, FIG. 2 is a perspective view of the vehicle lamp shown in FIG. 1, FIG. 3 is a front view of the vehicle lamp shown in FIG. 2, and FIG. 4 is a sectional view of the vehicle lamp shown in FIG. 1 taken along a B-B line.

As shown in FIG. 1 to FIG. 3, a vehicle lamp 1 is used as the headlamp of a car, or the like. This vehicle lamp 1 is equipped with three semiconductor light emitting devices 2, 3, 4 used as a light source, and a reflector 5 for reflecting lights emitted from the semiconductor light emitting devices 2, 3, 4 to a forward area of the lamp. This vehicle lamp 1 is arranged in a light compartment 9 that is constructed by a lamp body 7 whose front area is open, and a transparent front cover 8 fitted to the front opening portion of the body 7.

The reflector 5 is formed of the aluminum die casting and has three reflecting surfaces 11, 12, 13. The reflecting surfaces 11, 12, 13 are formed radially around a lamp optical axis Ax (see FIG. 1) as an axis in the irradiation direction of the lamp that extends in the longitudinal direction of the vehicle. Then, an outer peripheral portion of the reflector 5 is screwed on a supporting block 25 formed of the aluminum die casting. The supporting block 25 is fitted to the lamp body 7 via an aiming mechanism 10. The optical axis of a light emitted from the vehicle lamp 1 can be adjusted by changing a fitting angle of the reflector 5 via the aiming mechanism 10.

Also, the reflector 5 and the supporting block 25 are surrounded by a substantially cylindrical extension 15. This extension 15 is fixed to the lamp body 7 separately from the supporting block 25 via a fitting portion (not shown).

Mutual boundary portions between respective reflecting surfaces of the reflector 5 constitute ridge line portions 16 that protrude toward the front side of the lamp from the surrounding area. Also, three ridge line portions 16 come together at a reflector center C through which the lamp optical axis Ax passes. The reflector center C is formed as the top portion that protrudes most toward the front side of the lamp from all reflecting surfaces 11, 12, 13.

Three semiconductor light emitting devices 2, 3, 4 are LEDs and have substantially rectangular light emitting portions 2*a*, 3*a*, 4*a*. The semiconductor light emitting devices 2, 3, 4 are arranged on the lamp external wall 15 positioned on an outer peripheries of the reflecting surface 11, 12, 13 such that the light emitting portions 2*a*, 3*a*, 4*a* are directed toward the reflector center C through which the lamp optical axis Ax passes.

In the vehicle lamp 1 of one or more embodiments, three light emitting areas 21, 22, 23 are formed by a combination of the reflecting surfaces 11, 12, 13 and the semiconductor light emitting devices 2, 3, 4 arranged on their peripheries. Three light emitting areas 21, 22, 23 partitioned mutually are arranged in a radial fashion around the reflector center C.

That is, according to the vehicle lamp 1 of one or more embodiments, the light emitting areas 21, 22, 23 are formed radially around the lamp optical axis Ax and the semiconductor light emitting devices 2, 3, 4 are arranged on the outer peripheral portions of the light emitting areas 21, 22, 23 so as to direct their light emitting portions 2*a*, 3*a*, 4*a* to the radiation center, through which the lamp optical axis Ax passes, and the reflecting surfaces 11, 12, 13 reflect lights emitted from the semiconductor light emitting devices 2, 3, 4 to the front side of the lamp and are provided to the light emitting areas 21, 22, 23 respectively.

As shown in FIG. 1, and the semiconductor light emitting devices 2, 3, 4 are fixed to the supporting block 25 that is screwed on the outer peripheral portion of the reflector 5. When the reflector 5 and the supporting block 25 are formed of the aluminum die casting whose thermal conductivity is large, a heat radiation performance of the semiconductor light emitting devices 2, 3, 4 can be improved. In one or more embodiments, the reflector 5 screwed on the supporting block 25 may be molded integrally with the supporting block 25.

Also, the vehicle lamp 1 has a control unit (lighting circuit) 30 that is connected to the power supply and turns on individually the semiconductor light emitting devices 2, 3, 4 in the light emitting areas 21, 22, 23. Also, the reflecting surfaces 11, 12, 13 of the light emitting areas 21, 22, 23 give a different light distribution pattern respectively.

Figure 5:
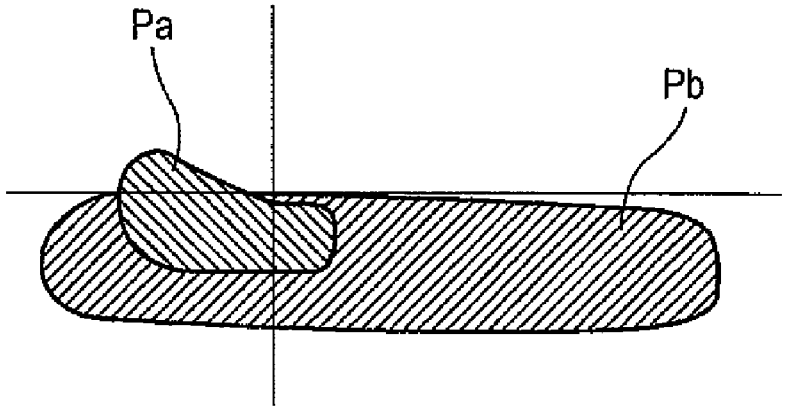
FIG. 5 is an explanatory view of a light distribution pattern formed by a combination of a diffusing light emitting area and an emerging light emitting area shown in FIG. 2.

As can be seen in the front view shown in FIG. 3, the reflecting surface 11 positioned on the upper right side has a reflecting surface 11*a* that is tilted at 15° to the horizontal direction, which causes the light distribution to converge reflected light. Thus, as shown in FIG. 5, the reflecting area 11 gives a light distributing pattern Pa that has a high illuminance and a narrow irradiation area.

Also, as shown in FIG. 3, the reflecting area 12 positioned on the lower side gives the light distribution to diffuse reflected light such that all cut directions of the reflecting surfaces are lined up in the horizontal direction. Thus, as shown in FIG. 5, the reflecting area 12 gives a light distributing pattern Pb that has a lower illuminance than the light distributing pattern Pa but has an irradiation area broadened in the horizontal direction.

Also, as shown in FIG. 3, the reflecting surface 13 positioned on the upper left side gives a high-beam light distribution pattern by a combination of the reflecting surfaces that are narrower than the diffusing reflecting area 12.

In one or more embodiments, the semiconductor light emitting device 3 in the light emitting area 22 is positioned under the lamp optical axis Ax and gives the diffusing light distribution, and is arranged such that, as shown in FIG. 4, a major axis 3*y* of the substantially rectangular light emitting portion 3*a* intersects orthogonally with the optical axis Ax.

Also, as shown in FIG. 1 and FIG. 3, optical components 27, 28, 29 for adjusting the emitting direction of the lights emitted from the reflecting surfaces 11, 12, 13 and the semiconductor light emitting devices 2, 3, 4 are provided to respective semiconductor light emitting devices 2, 3, 4 on the front side of the lamp in the light emitting areas 21, 22, 23.

Each of the optical components 27, 28, 29 is a lens member, which is formed of a transparent resin or glass, and whose outer surface is shaped into a ¼ spherical shape. The optical components 27, 28, 29 are screwed onto the supporting block 25 by a fitting screw 24 respectively. The optical components 27, 28, 29 has a function as a lens that adjusts an emission direction of the reflected light from the assigned reflecting surfaces 11, 12, 13 and a direct ray b1 emitted from the semiconductor light emitting devices 2, 3, 4 to the front side of the lamp, and a function as a shade that blocks a part of a reflected ray b2 from the reflecting surfaces 11, 12, 13 and a part of the direct ray emitted from the semiconductor light emitting devices 2, 3, 4 to the front side of the lamp.

The portion functioning as a shade prevents such a situation that the light is emitted to the forward area of the lamp by a total reflection in the lens. In this cases a light shielding performance may be enhanced by forming a reflecting surface on the surface of the lens member by the aluminum deposition, or the like.

As shown in FIG. 1, radiation fins 17 are formed on the rear surface of the reflector 5 at an appropriate interval. When a heat generated from the semiconductor light emitting devices 2, 3, 4 is transferred to the reflector 5, the radiation fins 17 emit effectively the transferred heat to the outside.

A dimming means is connected to the semiconductor light emitting device 2 assigned to the converging reflecting area 11. According to the dimming means, when a motorway light distribution is to be provided, a quantity of emission light can be increased by enhancing a luminous intensity. Also, the semiconductor light emitting device 2 are equipped with a leveling mechanism that controls the lamp optical axis Ax upwardly by 0.34° by adjusting the fitting angle of the vehicle lamp 1, so that when the motorway light distribution is to be provided, a distance reached by an irradiation light being emitted from the lamp is extended.

Figure 6A:
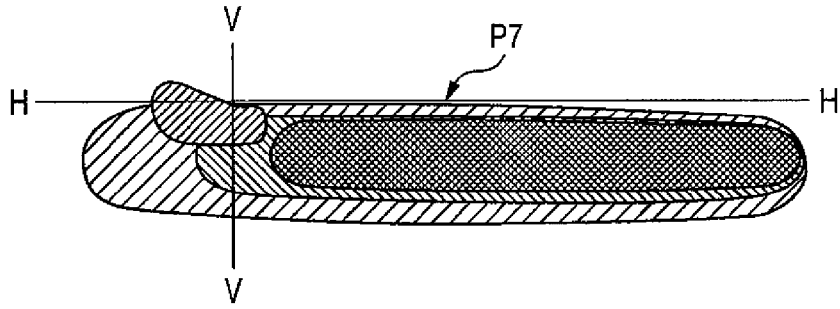
FIGS. 6A to 6C are explanatory views showing an example of a light distribution pattern formed by a combination of three type of light emitting areas shown in FIG. 3.
Figure 6B:
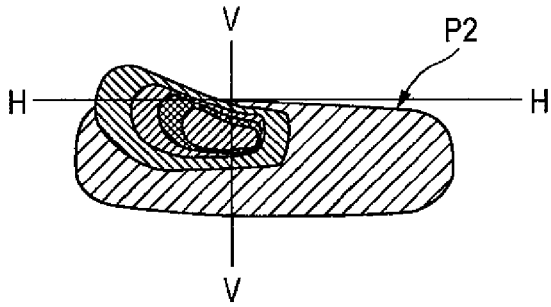
Figure 6C:
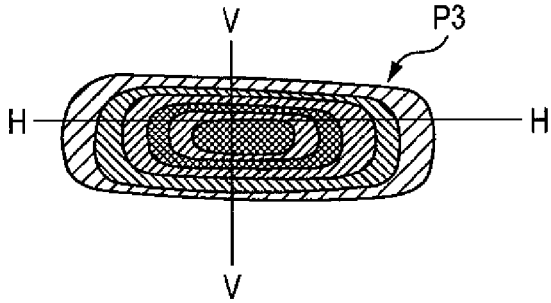

In the vehicle lamp 1, the lighting of the semiconductor light emitting devices 2, 3, 4 is controlled by a lighting circuit (not shown), and the light distribution pattern can be switched to various light distribution patterns P1, P2, P3, as shown in FIGS. 6A to 6C, by adjusting a luminous intensity by the dimming means or by adjusting the lamp optical axis by the leveling means.

A light distribution pattern P1 shown in FIG. 6A gives a bending light distribution pattern, a light distribution pattern P2 shown in FIG. 6B gives a motorway light distribution pattern, and a light distribution pattern P3 shown in FIG. 6C gives a high-beam light distribution pattern.

According to the vehicle lamp 1, mounting positions of the semiconductor light emitting devices 2, 3, 4 are set to the outer peripheral portion of the reflector 5 that provides the reflecting surfaces 11, 12, 13 in respective light emitting areas 21, 22, 23 and, as shown in FIG. 3, the semiconductor light emitting devices 2, 3, 4 in the adjacent light emitting areas 21, 22, 23 are largely separated mutually in the configuration. Therefore, a sufficient heat radiation area can be ensured around the semiconductor light emitting devices 2, 3, 4, and thus the heat generated from the semiconductor light emitting devices 2, 3, 4 can be radiated or such heat can be transferred effectively to the reflector 5, so that the heat can be radiated from the large rear surface area of the reflector 5 to the outside. Accordingly, a temperature rise due to heat generation of the semiconductor light emitting devices 2, 3, 4 themselves can be prevented.

As a result, a reduction of the light emitting performance or the life of the semiconductor light emitting devices 2, 3, 4 caused due to an excessive temperature rise can be prevented.

Also, because the mounting positions of the semiconductor light emitting devices 2, 3, 4 are set to the outer peripheral portion of the reflector 5, in a plurality of light emitting areas 21, 22, 23 formed radially around the lamp optical axis Ax, the boundary portions between the adjacent light emitting areas constitute the ridge line portions 16 being higher than the surrounding area and the fitting positions of the semiconductor light emitting devices 2, 3, 4. Also, the ridge line portions 16 protrude toward the front side of the lamp gradually as they come close to the center through which the lamp optical axis Ax passes.

Also, with such configuration, each of the ridge line portions 16, which are provided in a boundary between the adjacent light emitting areas 21, 22, 23, functions as a light shielding wall for preventing a situation in which the light emitted from the semiconductor light emitting devices 2, 3, 4 assigned to the light emitting areas 21, 22, 23 enters into another light emitting area that is not assigned to that light. Also, each of the ridge line portions 16 functions as another light shielding wall for preventing such a situation that a part of the light reflected by one reflecting surface in one light emitting area (e.g., the light emitting area 21) is reflected again by other reflecting surface in other light emitting area (e.g., the light emitting area 22). Therefore, mutual interference between the light distribution patterns in the light emitting areas 21, 22, 23 can be prevented, and thus the light distribution patterns in the respective reflecting surfaces can be shaped with high precision.

Also, in the vehicle lamp 1, the lighting circuit for individually lighting the semiconductor light emitting devices 2, 3, 4 provided in the light emitting areas 21, 22, such that the reflecting surfaces 11, 12, 13 in the light emitting areas 21, 22, 23 have the different light distribution patterns respectively.

Therefore, when plural light distribution patterns are synthesized as a whole, formation of the light distribution patterns in a more complicated illuminance distribution can be facilitated without providing a complicated light distribution adjusting mechanism such as the movable shade, or the like, as shown in FIGS. 6A to 6C. As a result, formation of light distribution patterns that conform to legal regulations for the illuminance distribution can be facilitated.

Also, a plurality of light distribution patterns can be switched simply by switching the light emitting areas 21, 22, 23 in which the semiconductor light emitting devices 2, 3, 4 are turned on respectively. Thus, an ideal light distribution in response to the driving mode can be obtained.

Also, in the vehicle lamp 1, the LEDs having the substantially rectangular light emitting portions 2*a*, 3*a*, 4*a* respectively are employed as the semiconductor light emitting devices 2, 3, 4. The semiconductor light emitting device 2 in the light emitting area 22 for the diffusing light distribution, which is positioned under the lamp optical axis Ax, is arranged such that, as shown in FIG. 4, the major axis 3*y* of the light emitting portion 3*a* intersects orthogonally with the optical axis Ax.

Therefore, when the reflecting surface 12 is shaped into the reflecting surface that is suitable for the diffusing light distribution in the width direction of vehicle, the diffusion light that diffuses in the width direction of vehicle and acts as a base of various light distributions can be obtained easily and, as shown in FIG. 5, the light distribution pattern Pb having a broad irradiation width can be easily obtained by the diffusion light.

Also, in the vehicle lamp 1, the optical components 27, 28, 29 for adjusting the emission direction of the light emitted from the reflecting surfaces 11, 12, 13 and the semiconductor light emitting devices 2, 3, 4 are provided to the semiconductor light emitting devices 2, 3, 4 on the front side of the lamp.

Therefore, not only the light distribution adjustment performed by the reflecting surfaces 11, 12, 13 of the reflector 5, but also, the light distribution adjustment performed by the optical components 27, 28, 29 can be applied. As a result, the light distribution patterns can be adjusted with higher precision.

Also, in the vehicle lamp 1 of the present embodiment, the lens member having a ¼ spherical shape as the optical components 27, 28, 29.

Therefore, in the illumination operation of the lamp, the optical components 27, 28, 29 transmit the ray reflected from the reflecting surfaces 11, 12, 13 of the reflector 5 or transmit the direct ray from the semiconductor light emitting devices 2, 3, 4 and give an external appearance respectively as if such optical components themselves emitted the light. Accordingly, a design property as the lamp can be improved.

The semiconductor light emitting devices, the reflector, the light emitting areas, the optical components, etc. according to the vehicle lamp of the present invention are not limited to the configurations in the above embodiments. It is, of course, that various configurations may be employed within the scope of the present invention.

For example, four light emitting areas or more may be formed by increasing the number of the ridge line portions 16 extending radially from the reflector center C, and a mutually different light distribution pattern may be assigned to respective light emitting areas.

Also, in the vehicle lamp 11 while the present embodiments have been described in connection with an example where three light emitting areas 21, 22, 23 formed radially on the lamp optical axis Ax passing through the reflector center C are provided, the axis in the lamp irradiating direction, which extends in the front-rear direction of the vehicle, is not limited to the lamp optical axis Ax passing through the reflector center C.

Also, in the above embodiments, the semiconductor light emitting device is assigned to respective reflecting surfaces 11, 12, 13 on a one-to-one basis. However, a quantity of light may be changed by changing the number of semiconductor light emitting devices 2, 3, 4 provided in each reflecting area.

Also, as the semiconductor light emitting devices 2, 3, 4, a laser diode ("LD") may be employed in place of the LED.

What is claimed is:

1. A vehicle lamp, comprising:

a plurality of semiconductor light emitting devices; and a reflector for reflecting light emitted from the semiconductor light emitting devices toward a front side of the vehicle lamp, wherein the reflector has surfaces partitioned into a plurality of light emitting areas that are radially formed around an optical axis extending in a front-rear direction of a vehicle, wherein each of the semiconductor light emitting devices is disposed on an outer peripheral portion of one of the light emitting areas respectively, and wherein each of the reflecting surfaces of the reflector is provided in one of the light emitting areas respectively, further comprising: a lighting circuit for individually lighting the semiconductor light emitting devices provided in the light emitting areas, wherein the reflecting surfaces in the light emitting areas have a different light distribution pattern respectively.

2. The vehicle lamp according to claim 1, wherein each of the semiconductor light emitting devices has a light emitting portion that is substantially rectangularly shaped, and the semiconductor light emitting device in the light emitting area located under the optical axis is disposed such that a major axis of the light emitting portion intersects orthogonally with the optical axis.

3. The vehicle lamp according to claim 1, wherein the reflector is partitioned into the plurality of light emitting areas by ridge line portions protruding toward the front side of the vehicle lamp, wherein the ridge line portions are provided in a boundary between the respective reflecting surfaces, wherein each of the ridge line portions come together at a center point of the reflector through which the optical axis passes, and wherein the center point protrudes most toward the front side of the vehicle lamp from the reflecting surfaces.

4. The vehicle lamp according to claim 1, further comprising:

a plurality of radiation fins formed on a rear surface of the reflector.

5. The vehicle lamp according to claim 1, further comprising:

dimming means for adjusting a luminous intensity of the semiconductor light emitting devices; and leveling means for adjusting the optical axis, wherein the light distribution pattern can be switched among various light distribution patterns by the dimming means or the leveling means.

6. A vehicle lamp, comprising:

a plurality of semiconductor light emitting devices; and a reflector for reflecting light emitted from the semiconductor light emitting devices toward a front side of the vehicle lamp, wherein the reflector has surfaces partitioned into a plurality of light emitting areas that are radially formed around an optical axis extending in a front-rear direction of a vehicle, wherein each of the semiconductor light emitting devices is disposed on an outer peripheral portion of one of the light emitting areas respectively, and wherein each of the reflecting surfaces of the reflector is provided in one of the light emitting areas respectively, further comprising: optical components provided directly in front of the semiconductor light emitting devices, wherein the optical components adjust an emission direction of light reflected by the reflecting surfaces and light directly from the semiconductor light emitting devices.

7. The vehicle lamp according to claim 6, wherein each of optical components has at least one of a lens function and shading function, wherein the lens function adjusts the emission direction of the light, and wherein the shading function blocks a part of the light.

8. The vehicle lamp according to claim 7, wherein the optical components comprise a lens member having a ¼ spherical shape.

* * * * *